US006621076B1

(12) United States Patent
van de Goor et al.

(10) Patent No.: US 6,621,076 B1
(45) Date of Patent: Sep. 16, 2003

(54) FLEXIBLE ASSEMBLY FOR TRANSPORTING SAMPLE FLUIDS INTO A MASS SPECTROMETER

(75) Inventors: Tom A. van de Goor, Foster City, CA (US); Kevin Patrick Killeen, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/136,825

(22) Filed: Apr. 30, 2002

(51) Int. Cl.[7] ..... H01J 49/04
(52) U.S. Cl. ..... 250/288
(58) Field of Search ..... 250/288, 281, 250/282; 210/198.2, 656; 204/600, 601, 500, 501; 422/69, 70

(56) References Cited

U.S. PATENT DOCUMENTS 5,500,071 A 3/1996 Kaltenbach et al.
5,571,410 A 11/1996 Swedberg et al.
5,645,702 A 7/1997 Witt et al.
5,658,413 A 8/1997 Kaltenbach et al.
5,779,868 A 7/1998 Parce et al.
5,882,571 A 3/1999 Kaltenbach et al.
5,994,696 A 11/1999 Tai et al.
6,033,628 A 3/2000 Kaltenbach et al.
6,054,047 A 4/2000 Hindsgaul et al.
6,066,848 A 5/2000 Kassel et al.
6,191,418 B1 2/2001 Hindsgaul et al.
6,207,954 B1 3/2001 Andrien, Jr. et al.
6,245,227 B1 6/2001 Moon et al.
6,459,080 B1 * 10/2002 Yin et al. ..... 250/288

* cited by examiner

*Primary Examiner*—Kiet T. Nguyen

(57) ABSTRACT

The invention relates to a device for transporting sample fluids into a mass spectrometer. The device comprises a well plate comprising a plurality of wells, a fluid transporting assembly, and a mass spectrometer interface. The fluid-transporting assembly is comprised of a plurality of fluid-transporting conduits, each extending from an inlet port to an outlet port, wherein the assembly exhibits sufficient flexibility to allow movable positioning of the outlet ports with respect to the inlet ports. Each inlet port of the fluid-transporting assembly is positioned in fluid communication with a different well of the well plate to form a plurality of flow paths. Each flow path originates at a well and travels, in succession, through the conduit inlet port, the conduit, the conduit outlet port, and the mass spectrometer interface. Fluids emerging from the mass spectrometer interface may be introduced into a mass spectrometer. The invention also provides a method for transporting sample fluids into a mass spectrometer.

36 Claims, 7 Drawing Sheets

FLEXIBLE ASSEMBLY FOR TRANSPORTING SAMPLE FLUIDS INTO A MASS SPECTROMETER

TECHNICAL FIELD

The present invention relates generally to the transport of sample fluids into a mass spectrometer. More particularly, the invention relates to devices and methods that use a flexible fluid-transporting assembly to deliver sample fluids from a well plate through a mass spectrometer interface directly into an inlet opening of a mass spectrometer.

BACKGROUND

Mass spectrometry is an important analytical technique for the identification of chemical or biochemical compounds. By ionizing sample molecules and sorting the ionized molecules according to their mass-to-charge ratios, mass spectrometry has demonstrated its usefulness in the identification of a wide variety of molecules, such as small organic compounds synthesized in large libraries, biological compounds, such as peptides, proteins, and carbohydrates, and a wide variety of naturally occurring compounds. For example, mass spectrometry may employ electrospray technology that allows ions to be produced from a sample fluid containing sample molecules in a carrier liquid. Typically, electrospray technology produces an ionized aerosol by passing a sample fluid through a rigid capillary extending in a horizontal direction and subjecting the outlet terminus of the capillary to an electric field. The electric field is usually generated by placing a source of electrical potential, e.g., an electrode, near the outlet terminus of the capillary, wherein the electrode is held at a voltage potential difference with respect to the outlet terminus. As the sample fluid exits the capillary from the outlet terminus, droplets having a net charge are formed. When the carrier liquid is evaporated from the droplets, ionized sample molecules are produced. In some instances, a plurality of capillaries may be employed to deliver ions from multiple sample fluids to a mass spectrometer. See, e.g., U.S. Pat. No. 6,191,418 to Hindsgaul et al. The ionized sample molecules are then sorted in a vacuum according to mass-to-charge ratio. When all sample molecules carry the same charge, e.g., are singly charged, sorting the ionized sample molecules according to mass-to-charge ratio is equivalent to sorting the sample molecules according to mass.

Microfluidic devices have also been proposed for use to carry out chemical analysis and processing. Their small size allows for the analysis and processing of minute quantities of a sample fluid, which is an advantage when the sample is expensive or difficult to obtain. See, e.g, U.S. Pat. No. 5,500,071 to Kaltenbach et al., U.S. Pat. No. 5,571,410 to Swedberg et al., and U.S. Pat. No. 5,645,702 to Witt et al. Typically, microfluidic devices are formed from substantially planar structures comprised of glass, silicon, or other rigid materials and employed in conjunction with internal or external motive means to move fluids therein for analysis and/or processing. Microfluidic devices represent a potentially inexpensive or disposable means that integrates sample preparation, separation, and detection functionality in a single tool. In addition, microfluidic devices are well suited to process and/or analyze small quantities of sample fluids with little or no sample waste.

A number of patents and applications have described the incorporation of electrospray technology in microfluidic devices. For example, U.S. Pat. No. 5,994,694 to Tai et al. describes a micromachined electrospray nozzle for mass spectrometry. Instead of using a glass capillary to delivery sample fluid for electrospray ionization, an overhanging silicon nitride microchannel serves as an electrospray ionization nozzle. The microchannel is located within a rigid silicon support substrate.

In addition, commonly owned U.S. Ser. No. 09/324,344 ("Miniaturized Device for Sample Processing and Mass Spectroscopic Detection of Liquid Phase Samples"), inventors Yin, Chakel, and Swedberg (claiming priority to Provisional Patent Application No. 60/089,033), describes a miniaturized device for sample processing and mass spectroscopic detection of liquid phase samples. The described device comprises a substrate having a feature on a surface in combination with a cover plate. Together, a protrusion on the substrate and a corresponding protrusion on the cover plate may form an on-device mass spectrometer delivery means. On-device features such as microchannels and apertures may be formed through laser ablation or other techniques. Other commonly owned applications include: U.S. Ser. No. 09/711,804, which describes a similar microfluidic device having a protruding electrospray emitter; and U.S. Ser. No. 09/820,321, which describes a microfluidic device that includes a means for nebulizing a sample fluid from an outlet of the microfluidic device for delivery into an ionization chamber.

There is a current need in the pharmaceutical industry to quickly screen, identify, and/or process a large number and/or variety of samples. For instance, the samples may represent a collection or library of organic and/or biological compounds. Such compounds may originate from a number of sources and may be, for example, extracted from naturally occurring plants and animals or synthesized as a result of combinatorial techniques. In particular, there is a need to screen biological compounds, such as peptides, proteins, and carbohydrates. Thus, microfluidic devices may contain multiplexed features of multiple inlets and multiple spray tips. For example, U.S. Pat. No. 6,245,227 to Moon et al. describes an integrated monolithic microfabricated electrospray nozzle and liquid chromatography system. This patent also proposes that an array of multiple systems may be fabricated in a single monolithic chip for rapid sequential fluid processing and generation of electrospray for subsequent analysis.

Well plates are often used to store a large number of samples for screening and/or processing. Well plates are typically single piece items that comprise a plurality of wells, wherein each well is adapted to contain a sample fluid. Each well of the well plate has a small interior volume, defined in part by an interior surface extending downwardly from an opening at an upper surface of the well plate. Such well plates are commercially available in standardized sizes and may contain, for example, 96, 384, or 1536 wells per well plate.

To bring these samples from their containers to the mass spectrometer, with or without intermediate processing is currently a cumbersome task, requiring excessive fluid volume and time. Pipettes are typically employed to convey sample fluid from the wells of a well plate into an inlet of an analytical and/or processing device. While robotic and/or automated systems using pipette technology may be configured to handle a large number of sample fluids, pipettes suffer from a number of intrinsic drawbacks. For example, pipettes are incapable of performing continuous fluid transfer from a well to the inlet. In addition, many pipettes are typically incapable of dispensing fluids in a horizontal direction into an analytical and/or processing device. Thus, there is a need for a fluid-transporting device that overcomes the drawbacks of pipettes.

Although microfluidic devices often comprise motive means that are well suited for effecting controlled fluid flow, such devices are generally unsuitable for transporting sample fluids directly from a sample well to a mass spectrometer. As discussed above, most microfluidic devices are made from glass, silicon, or other rigid structures. While it is possible to place such devices directly over a well plate in an attempt to transport fluids directly from the sample well for processing before introduction into a mass spectrometer, typical microfluidic device construction would require the device to be positioned vertically on its edge, which would adversely affect control over fluid flow. In addition, when electrospray nozzles are an integral part of a rigid microfluidic device, it may be difficult to achieve the proper alignment needed to carry out mass spectrometry. That is, the relative positions of the well plate, microfluidic device, and a mass spectrometer inlet have to be precisely and appropriately situated to rapidly and efficiently perform mass spectrometric analysis for a plurality of sample fluids.

Thus, there is a need in the art to improve sample transport from a well plate into mass spectrometric devices and, optionally, to exploit the motive means and functionality associated with microfluidic devices. Furthermore, there is a need to provide a means to overcome the inherent alignment problems associated with rigid microfluidic devices for use in mass spectrometry.

SUMMARY OF THE INVENTION

In a first embodiment, the invention relates to a device for transporting sample fluids to a mass spectrometer. The device comprises a well plate, a fluid transporting assembly, and a mass spectrometer interface. The well plate is comprised of a plurality of wells, wherein each well is defined by an interior surface extending downwardly from an opening at an upper surface of the well plate. The fluid-transporting assembly is comprised of a plurality of fluid-transporting conduits, each extending from an inlet port to an outlet port, wherein the assembly exhibits sufficient flexibility to allow movable positioning of the outlet ports with respect to the inlet ports. Each inlet port of the fluid-transporting assembly is positioned in fluid communication with a different well of the well plate to allow any sample fluid contained in the well to be transported upwardly through the well opening and into the inlet port. The mass spectrometer interface is provided in fluid communication with the outlet ports of the fluid-transporting assembly. As a result, a plurality of flow paths is formed, each flow path originating at a well and traveling in succession through the conduit inlet port, the conduit, the conduit outlet port, and the mass spectrometer interface. Fluids emerging from the mass spectrometer interface are then introduced into a mass spectrometer.

Typically, the fluid-transporting assembly is formed from a substrate and a cover plate arranged in fluid-tight relationship over the substrate surface, and the fluid-transporting conduits are each defined by a channel formed in the substrate surface in combination with the cover plate. The substrate, the cover plate, or both may be comprised of a polymeric material, preferably a biofouling-resistant material such as polyimide. Optionally, a plurality of processing chambers is also provided, wherein each chamber is in fluid communication with a conduit of the fluid-transporting assembly to allow sample fluid processing to take place therein after a sample fluid exits a well and before the sample fluid enters the mass spectrometer interface.

In addition, the mass spectrometer interface may be constructed according to a desired function. Thus, the interface may comprise one or more electrospray nozzles. In such a case, the interface typically comprises an electrically conductive material. For example, a metallization layer may be provided on an interior and/or exterior surface of the mass spectrometer interface. In addition, the mass spectrometer interface may be formed as a discrete component that is attached to the fluid-transporting assembly, or formed as an integral portion of the fluid-transporting assembly.

In order to transport fluid from the wells and through the fluid transporting assembly, the inventive device may further include a motive means to transport sample fluid from each well upwardly through the fluid-transporting conduit in fluid communication therewith. In some instances, the motive means may comprise applying a voltage differential to induce electrokinetic flow. In addition or in the alternative, the motive means may comprise pressurizing at least one of the wells of the well plate.

Thus, in another embodiment, the invention relates to a mass spectrometric analytical device. The device comprises a well plate as described above, a fluid-transporting assembly, and a mass spectrometer interface. In addition, the fluid-transporting assembly comprises a substrate having a plurality of microchannels formed in a surface thereof, and a cover plate arranged in fluid-tight relationship over the substrate surface, wherein the cover plate and the microchannels together define a plurality of fluid-transporting conduits, each extending from an inlet port to an outlet port. Furthermore, a mass spectrometer inlet opening is provided in a fluid-receiving relationship to the mass spectrometer interface, which in turn, is in fluid communication with the outlet ports of the fluid-transporting assembly. Again, each inlet port of the fluid-transporting assembly is positioned in fluid communication with a different well of the well plate. As a result, a plurality of flow paths is formed, each flow path originating at a well and traveling in succession through the conduit inlet port, the conduit, the conduit outlet port, and the mass spectrometer interface. The fluid-transporting assembly is arranged such that the direction of the flow path from the wells to the fluid-transporting assembly differs from the direction of the flow path from the mass spectrometer interface to the mass spectrometer inlet opening.

In a further embodiment, the invention relates to a method for transporting a plurality of sample fluids to a mass spectrometer. The method involves: (a) providing a mass spectrometer interface and a fluid-transporting assembly that comprises a plurality of fluid-transporting conduits, each extending from an inlet port to an outlet port and exhibiting sufficient flexibility to allow movable positioning of the outlet port with respect to the inlet port, wherein at least one outlet port is in fluid communication with the mass spectrometer interface; (b) placing each inlet port of the fluid-transporting assembly in fluid communication with a different well of a well plate, wherein the well plate comprises a plurality of wells, each containing a sample fluid and further, wherein each well is defined by an interior surface extending downwardly from an opening at an upper surface of the well plate; (c) positioning the mass spectrometer interface to introduce a sample fluid from the well plate into an inlet port of a mass spectrometer; and (d) applying a motive force to transport a sample fluid from a selected well of the well plate through the opening of the selected well, the conduit in communication with the selected well, the mass spectrometer interface, and the inlet port of the mass spectrometer; wherein the direction in which the sample fluid is transported through the opening of the selected well is different from the direction in which the sample fluid is transported through the inlet port of the mass spectrometer.

BRIEF DESCRIPTION OF THE DRAWINGS

FIG. 1A illustrates the device in exploded and unassembled view. FIG. 1B schematically illustrates the device in top view and in partially assembled form. FIG. 1C schematically illustrates the device in cross-sectional view and in fully assembled view along the plane defined by the first conduit of the fluid-transporting assembly. FIG. 1D schematically illustrates the well plate in cross-sectional view along the plane indicated by dotted line A in FIG. 1A.

FIG. 2A illustrates the assembly in exploded view, and FIG. 2B illustrates the assembly as assembled in schematic view.

FIG. 3A illustrates the assembly in exploded view, and FIG. 3B illustrates the assembly as assembled in schematic view.

DETAILED DESCRIPTION OF THE INVENTION

Figure 1A:
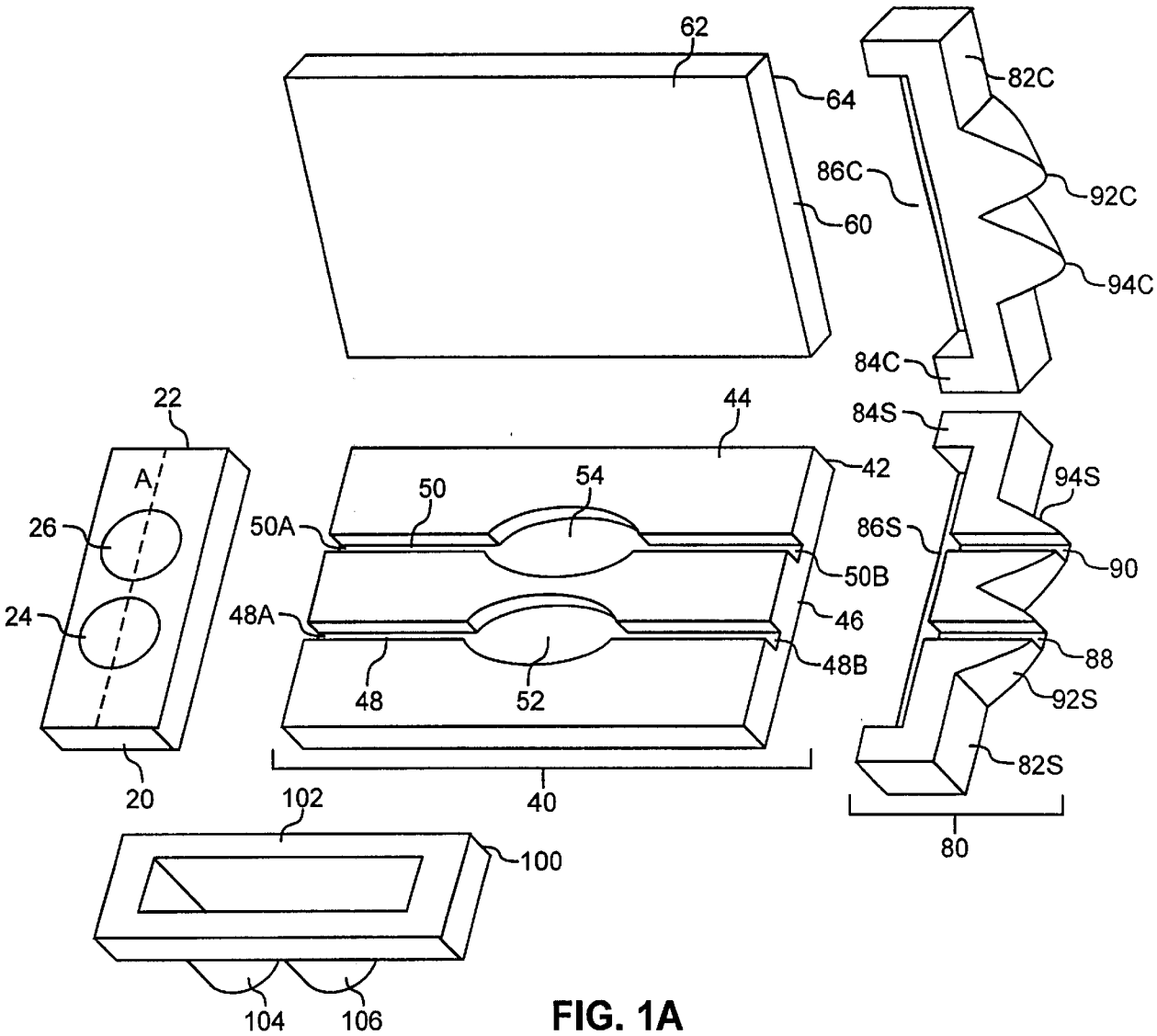
FIGS. 1A–1D, collectively referred to as FIG. 1, illustrate an embodiment of the inventive device that includes a well plate, a fluid-transporting assembly, and a mass spectrometer interface.

Before the invention is described in detail, it is to be understood that, unless otherwise indicated, this invention is not limited to particular materials, components, or manufacturing processes, as such may vary. It is also to be understood that the terminology used herein is for purposes of describing particular embodiments only, and is not intended to be limiting.

It must be noted that, as used in the specification and the appended claims, the singular forms "a," "an," and "the" include plural referents unless the context clearly dictates otherwise. Thus, for example, reference to "an inlet" includes a plurality of inlets as well as a single inlet, reference to "a fluid" includes a mixture of fluids as well as a single fluid, and the like.

In this specification and in the claims that follow, reference will be made to a number of terms that shall be defined to have the following meanings:

The term "fluid-tight" is used herein to describe the spatial relationship between two solid surfaces in physical contact, such that fluid is prevented from flowing into the interface between the surfaces.

The term "fluid-transporting feature" as used herein refers to an arrangement of solid bodies or portions thereof that direct fluid flow. Fluid-transporting features include, but are not limited to, chambers, reservoirs, conduits, and channels. The term "conduit" as used herein refers to a three-dimensional enclosure formed by one or more walls and having an inlet opening and an outlet opening through which fluid may be transported. The term "channel" is used herein to refer to an open groove or a trench in a surface. A channel in combination with a solid piece over the channel forms a "conduit".

The term "in succession" is used herein to refer to a sequence of events. When a flow path travels "in succession" through an inlet port and a conduit, fluids flowing along the flow path travel through the inlet port either before, or at least no later, than they travel through the conduit. "In succession" does not necessarily mean consecutively. For example, a fluid traveling in succession through an inlet port and an outlet port does not preclude the fluid from passing through a conduit in between the inlet port and the outlet port.

The term "microalignment means" is defined herein to refer to any means for ensuring the precise microalignment of microfabricated features in a microfluidic device. Microalignment means can be formed either by laser ablation or by other methods well known in the art that are used to fabricate shaped pieces. Representative microalignment means that can be employed herein include a plurality of appropriately arranged protrusions in component parts, e.g., projections, depressions, grooves, ridges, guides, or the like.

The term "microfluidic device" refers to a device having features of micrometer or submicrometer dimensions, and that can be used in any number of chemical processes involving minute quantities of fluid. Such processes include, but are not limited to, electrophoresis (e.g., capillary electrophoresis, or CE), chromatography (e.g., $\mu$LC), screening and diagnostics (e.g., using hybridization or other binding means), and chemical and biochemical synthesis or analysis (e.g., through enzymatic digestion). The features of the microfluidic devices are adapted to the particular use intended. For example, microfluidic devices that are used in separation processes such as chromatography contain microchannels (termed herein as "microconduits" when they are enclosed, i.e., when the cover plate is in place on the microchannel-containing substrate surface) on the order of 1 $\mu$m to 200 $\mu$m in diameter, typically 10 $\mu$m to 75 $\mu$m in diameter, and approximately 0.1 to 50 cm in length.

The term "motive means" is used to refer to any means for inducing movement of a sample fluid along a conduit, such as that required in a liquid phase analysis, and includes application of an electric potential across any portion of the conduit, application of a pressure differential across any portion of the conduit, or any combination thereof.

The term "nebulize" as used herein means to spray, atomize, or otherwise disperse a sample fluid into small droplets. "Optional" or "optionally" as used herein means that the subsequently described feature or structure may or may not be present, or that the subsequently described event or circumstance may or may not occur, and that the description includes instances where a particular feature or structure is present and instances where the feature or structure is absent, or instances where the event or circumstance occurs and instances where it does not.

Thus, the invention generally relates to a device for transporting sample fluids to a mass spectrometer for analysis. The device allows a plurality of fluids to be controllably transported from a well plate through a fluid-transporting assembly to a mass spectrometer interface. The fluid-transporting assembly is comprised of a plurality of fluid-transporting conduits, each extending from an inlet port to an outlet port, wherein each inlet port of the fluid-transporting assembly is positioned in fluid communication with a different well of the well plate to allow any sample fluid contained in the well to be transported upwardly through the well opening and into the inlet port. The mass spectrometer interface is provided in fluid communication with the outlet ports of the fluid-transporting assembly. Typically, the fluid-transporting assembly comprises a microfluidic device that optionally performs additional analysis and/or processing on the sample fluids as the sample fluids are transported therethrough. Advantageously, the fluid-transporting assembly is made from one or more flexible materials, such that the assembly exhibits sufficient flexibility to allow movable positioning of the outlet ports with respect to the inlet ports. This overcomes the inherent problems associated with the use of rigid devices to transport sample fluids from a well plate to a mass spectrometer interface.

FIG. 1 illustrates an embodiment of the inventive device. As with all figures referenced herein, in which like parts are referenced by like numerals, FIG. 1 is not to scale, and certain dimensions may be exaggerated for clarity of presentation. As shown, the inventive device 10 includes well plate 20, a fluid-transporting assembly 40, and a mass spectrometer interface 80. As with all well plates used in the present invention, each well of well plate 20 is defined by an interior surface extending downwardly from an opening at an upper surface 22 of the well plate and is adapted to contain a sample fluid. Thus, as shown in FIGS. 1A and 1D, well plate 20 includes first and second wells indicated at 24 and 26, respectively. Wells 24 and 26 each have an associated opening, indicated at 28 and 30, respectively, located at upper surface 22. As upper surface 22 is a substantially planar surface, openings 28 and 30 are coplanar with respect to each other.

Each well contains a sample fluid. The first well 24 contains a first fluid 32, and the second well 26 contains a second fluid 34. Fluids 32 and 34 may be the same or different. As shown, the wells are of substantially identical construction, although identical well construction is not a requirement. In addition, the wells are optimally, although not necessarily, arranged in an array. Each of the wells 24 and 26 as shown is axially symmetric, although other shapes may be used.

The materials used to construct the wells of the well plate must be compatible with the fluids contained therein. Thus, if it is intended that the wells contain an organic solvent such as acetonitrile, polymers that dissolve or swell in acetonitrile would be unsuitable for use in forming the wells. For water-based fluids, a number of materials are suitable for the construction of wells, including, but not limited to, ceramics such as silicon oxide and aluminum oxide, metals such as stainless steel and platinum, and polymers such as polyester and polytetrafluoroethylene. Many well plates suitable for use with the employed device are commercially available and may contain, for example, 96, 384, or 1536 wells per well plate. Manufactures of suitable well plates for use in the employed device include Corning Inc. (Corning, N.Y. and Greiner America, Inc. (Lake Mary, Fla.).

The fluid-transporting assembly 40, as all fluid-transporting assemblies described herein, comprises a plurality of fluid-transporting conduits, each extending from an inlet port to an outlet port. The assembly, therefore, may be provided as a collection of individual conduits, capillaries, tubes, and the like, as well as conduits that extend through an integrated item. For example, the assembly may be constructed using ordinary microfluidic construction techniques, as discussed below. FIG. 1A depicts a fluid-transporting assembly 40 having a typical microfluidic device construction that is formed from a substrate 42 and a cover plate 60. The substrate, as shown, comprises first and second substantially planar and rectangular opposing surfaces, indicated at 44 and 46, respectively. The substrate 42 has a plurality of fluid-transporting features in the form of first and second parallel and identically sized microchannels indicated at 48 and 50, respectively, each microchannel located in the first planar surface 44. It will be readily appreciated that, although the microchannels 48 and 50 have been represented in a generally extended form, microchannels can assume a variety of path configurations, such as straight, serpentine, spiral, or tortuous. Furthermore, the microchannel cross-sections can assume a wide variety of geometries, including semicircular, rectangular, rhomboidal, and the like; and the channels can have a wide range of aspect ratios. The microchannels 48 and 50 extend from upstream termini, 48A and 50A, respectively, to downstream termini 48B and 50B, respectively. As shown, the upstream and downstream termini of the microchannels are located at opposing edges of the substrate. Optionally, fluid processing features 52 and 54 are provided as well on substrate surface 44. As shown, fluid processing features 52 and 54 occupy a portion of the volume of microchannels 48 and 50, respectively. That is, each fluid-processing feature substantially overlies a microchannel between the microchannel's termini.

Figure 1B:
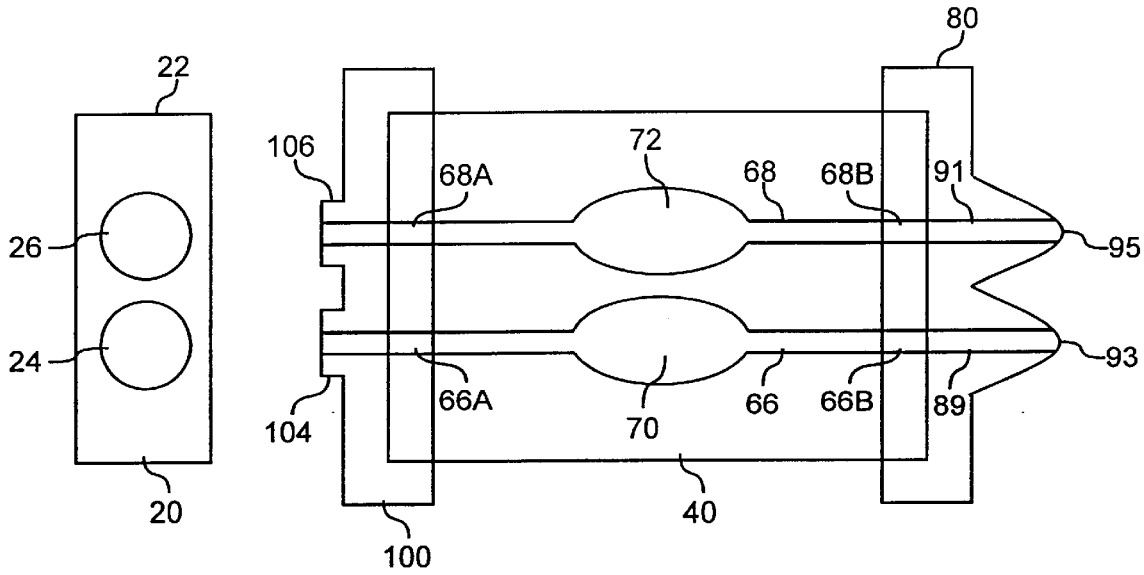

Cover plate 60 comprises first and second substantially planar opposing rectangular surfaces indicated at 62 and 64, respectively. Cover plate contact surface 62 has the same size and shape as substrate contact surface 44 and is arranged in fluid-tight relationship thereover. As depicted in FIG. 1B, fluid-transporting conduits 66 and 68, and processing chambers 70 and 72, are formed. Fluid-transporting conduits 66 and 68 are defined by microchannels 48 and 50, respectively, in combination with cover plate surface 62. The upstream termini 48A and 50A of the microchannels, in combination with the cover plate contact surface 62, form inlet ports 66A and 68A, respectively, and downstream termini 48B and 50B of the microchannels form, in combination with cover plate contact surface 62, form outlet ports 66B and 68B, respectively. Similarly, fluid-processing features 52 and 54, in combination with cover plate surface 62, respectively, define processing chambers 70 and 72. Thus, the processing chambers are each located between the substrate and cover plate, and fluidly communicate the conduits downstream from the associated the inlet ports and upstream from the associated outlet ports.

Also provided is a mass spectrometer interface 80. Although mass spectrometer interfaces may be constructed from one of many designs, the interface shown in FIG. 1 has a similar construction to the other microfluidics device. As depicted in FIG. 1A, the mass spectrometer interface is formed from two substantially identically shaped interface halves indicated at 82C and 82S. The halves each have a surface, indicated at 84C and 84S,which will ultimately be located within the assembled interface. Recesses 86C and 86S are formed on the surfaces 84C and 84S, respectively. Located on the contact surface 84S are channels 88 and 90 that extend from recess 86S through protrusions 92S and 94S, respectively. In order to assemble the mass spectrometer interface, the halves 82C and 82S are assembled such that the surfaces 84C and 84S contact with each other, and that protrusions 92C and 94C of half 82C are superimposed over protrusions 92S and 94S of half 82S.

Figure 1C:
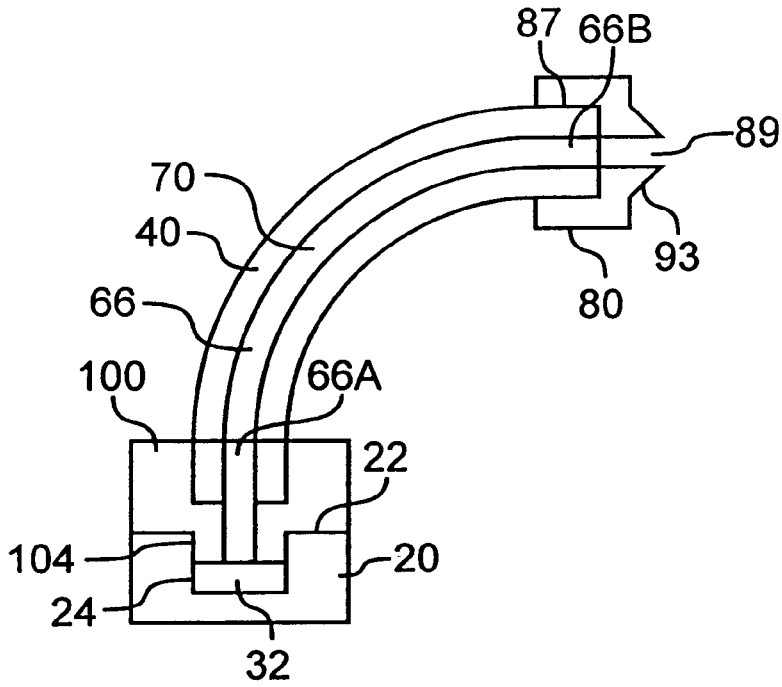
Figure 1D:
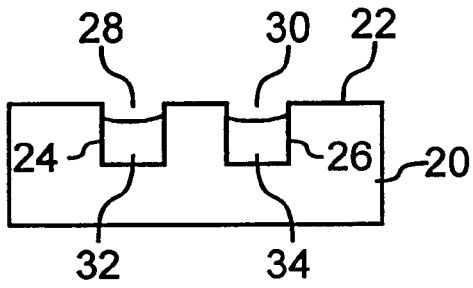

As depicted in FIGS. 1B and 1C, the mass spectrometer interface is assembled such that recesses 86C and 86S form a receiving compartment 87 into which the downstream end of the fluid-transporting assembly 40 may be inserted. Conduits 89 and 91 are formed by the combination of channels 88 and 90, respectively. Nozzle 93 is formed from protrusions 92C and 92S, and nozzle 95 is formed from protrusions 94C and 92S. Thus, conduits 89 and 91 each extend from receiving compartment 87 through nozzles 93 and 95, respectively, and provide a flow path through which fluid from conduits 66 and 68, respectively, of the fluid-transporting assembly 40 may flow. As shown, the mass spectrometer interface comprises the same number of electrospray nozzles as the number of fluid-transporting conduits of the fluid-transporting assembly.

Optionally, as depicted in FIG. 1, the inventive device may include a well plate interface 100. As depicted, well plate interface 100 has a single-piece construction that includes a receiving compartment 102 into which the upstream end of the fluid-transporting assembly 40 may be inserted. Integrally located opposite to the receiving compartment 102 are jutting fittings 104 and 106. The fittings 104 and 106 are sized for insertion through well openings 28 and 30 such that their exterior surfaces form a fluid-tight seal against the interior surfaces of wells 24 and 26, respectively. Conduits 108 and 110 extend from receiving compartment 102 through fittings 104 and 106, respectively, and provide flow paths through which fluid in fluid-transporting assembly 40 may flow. Thus, a flow path may be formed originating from each of the wells to the mass spectrometer interface.

The device may be assembled such that each inlet port of the fluid transporting assembly is positioned in fluid communication with a different well of the well plate. In addition, the mass spectrometer interface is placed in fluid communication with the outlet ports of the fluid-transporting assembly. This is illustrated in FIG. 1C. As shown, fittings 104 and 106 are inserted through well openings 28 and 30 such that their exterior surfaces form a fluid-tight seal against the interior surfaces of wells 24 and 26, respectively. Similarly, the upstream portion of the fluid-transporting assembly 40 is inserted into the receiving compartment 102 of the well plate interface 100. As a result, a flow path may be formed that originates from well 24 and that travels, in succession, through conduit 108 of the well plate interface 100, inlet port 66A, the upstream portion of microconduit 66, processing chamber 70, the downstream portion of microconduit 66, outlet port 66B, and conduit 89 of the mass spectrometer interface. A similar flow path may be formed originating from well 26 as well.

As illustrated in FIG. 1C, the fluid-transporting assembly 40 has sufficient flexibility to allow movable positioning of its outlet ports with respect to its inlet ports. That is, ordinarily fluid-transporting conduit 66 may be curved as a result. Typically, the fluid-transporting assembly has sufficient flexibility to alter the direction of fluid flow therein by at least about 30°. Preferably, the direction of fluid flow may be altered by at least about 45°. Optimally, the assembly has sufficient flexibility to alter the direction of fluid flow by about 60° to about 120°. As shown in FIG. 1C, the fluid-transporting assembly exhibits a curve of about 90°.

Suitable materials for forming the substrates and cover plates as described above are selected with regard to physical and chemical characteristics that are desirable for proper functioning of the fluid-transporting assembly. As an initial matter, the material used in the construction of the substrates and cover plates must be compatible with the fluids transported through the assembly. That is, the materials should be chemically inert and physically stable (e.g., in terms of pH, electric fields, etc.) with respect to any substance with which they come into contact when in use. Since the fluid-transporting assembly serves a comparable function to microfluidic devices such as those described in U.S. patent application Ser. No. 09/711,804, suitable materials for the present invention are similar to those described in U.S. patent application Ser. No. 09/711,804. Briefly, the substrate should be fabricated from a material that enables formation of high definition (or high "resolution") features, i.e., microchannels, chambers, and the like, that are of micrometer or submicrometer dimensions. That is, the material must be capable of microfabrication using material removal or addition techniques.

Polymeric materials are particularly preferred herein, typically organic polymers that are either homopolymers or copolymers, whether naturally occurring or synthetic, and crosslinked or uncrosslinked. Specific polymers of interest include, but are not limited to, polyimides, polycarbonates, polyesters, polyamides, polyethers, polyurethanes, polyfluorocarbons, polystyrenes, poly(acrylonitrile-butadiene-styrene)(ABS), acrylate and acrylic acid polymers such as polymethyl methacrylate, other substituted and unsubstituted polyolefins, and copolymers thereof. Generally, at least one of the substrate and cover plate comprises a biofouling-resistant polymer when the microfluidic device is employed to transport biological fluids. Polyimide, a biofouling-resistant material, is of particular interest and has proven to be a highly desirable substrate material in a number of contexts. Polyimides are commercially available, e.g., under the tradenames Kapton®, (DuPont, Wilmington, Del.) and Upilex® (Ube Industries, Ltd., Japan). Polyetheretherketones (PEEK) also exhibit desirable biofouling-resistant properties.

Furthermore, the fluid-transporting assembly may be fabricated from a "composite," i.e., a composition comprised of unlike materials. The composite may be a block composite, e.g., an A-B-A block composite, an A-B-C block composite, or the like. Alternatively, the composite may be a heterogeneous combination of materials, i.e., in which the materials are distinct separate phases; or it may be a homogeneous combination of unlike materials. As used herein, the term "composite" is used to include a "laminate" composite. A "laminate" refers to a composite material formed from several different bonded layers of identical or different materials.

The fluid-transporting assembly can be fabricated using any convenient method, including, but not limited to, micromolding and casting techniques, embossing methods, surface micromachining, and bulk-micromachining. Laser ablation is a preferred technique for preparing the fluid-transporting assembly. The fabrication technique used should further allow for features of sufficiently high definition, i.e., microscale components, channels, chambers, etc., such that precise "microalignment" of these features is possible. That is, the features must be capable of precise and accurate alignment, including, for example, the alignment of complementary microchannels with each other, the alignment of projections and mating depressions, the alignment of grooves and mating ridges, and the like.

In some instances, the substrate and the cover plate may be formed in a single, solid flexible piece. Microfluidic devices having a single-piece substrate and cover plate configuration have been described, e.g., in U.S. Pat. Nos. 5,658,413 and 5,882,571, each to Kaltenbach et al. The cover plate and substrate of the inventive device are, however, typically formed as discrete components. In such a case, microalignment means described herein or known to one of ordinary skill in the art may be employed to align the cover plate with the substrate. To ensure that the conduits formed between the substrate and the cover plate are fluid-tight, pressure-sealing techniques may be employed, e.g., by using chemical means (e.g., adhesive or welding) to hold the pieces together. In some instances, however, external means (such as clips, tension springs, or an associated clamp), or internal means (such as male and female couplings) may be used as well.

In order for the fluid-transporting assembly to exhibit sufficient flexibility to allow movable positioning of its outlet ports with respect to its inlet ports, the substrate and cover plate are made from flexible materials and are positioned such that their surfaces maintain fluid-tight contact. In addition, the conduits and other fluid-transporting features contained therein should not collapse or become obstructed from the bending of the fluid-transporting assembly. Thus, either or both the cover plate and the substrate should exhibit a thickness of no more than about 1000 micrometers. Typically, the cover plate and substrate each have a thickness of about 10 to 500 micrometers. Preferably, the cover plate and substrate each have a thickness of about 100 to about 250 micrometers.

Figure 2A:
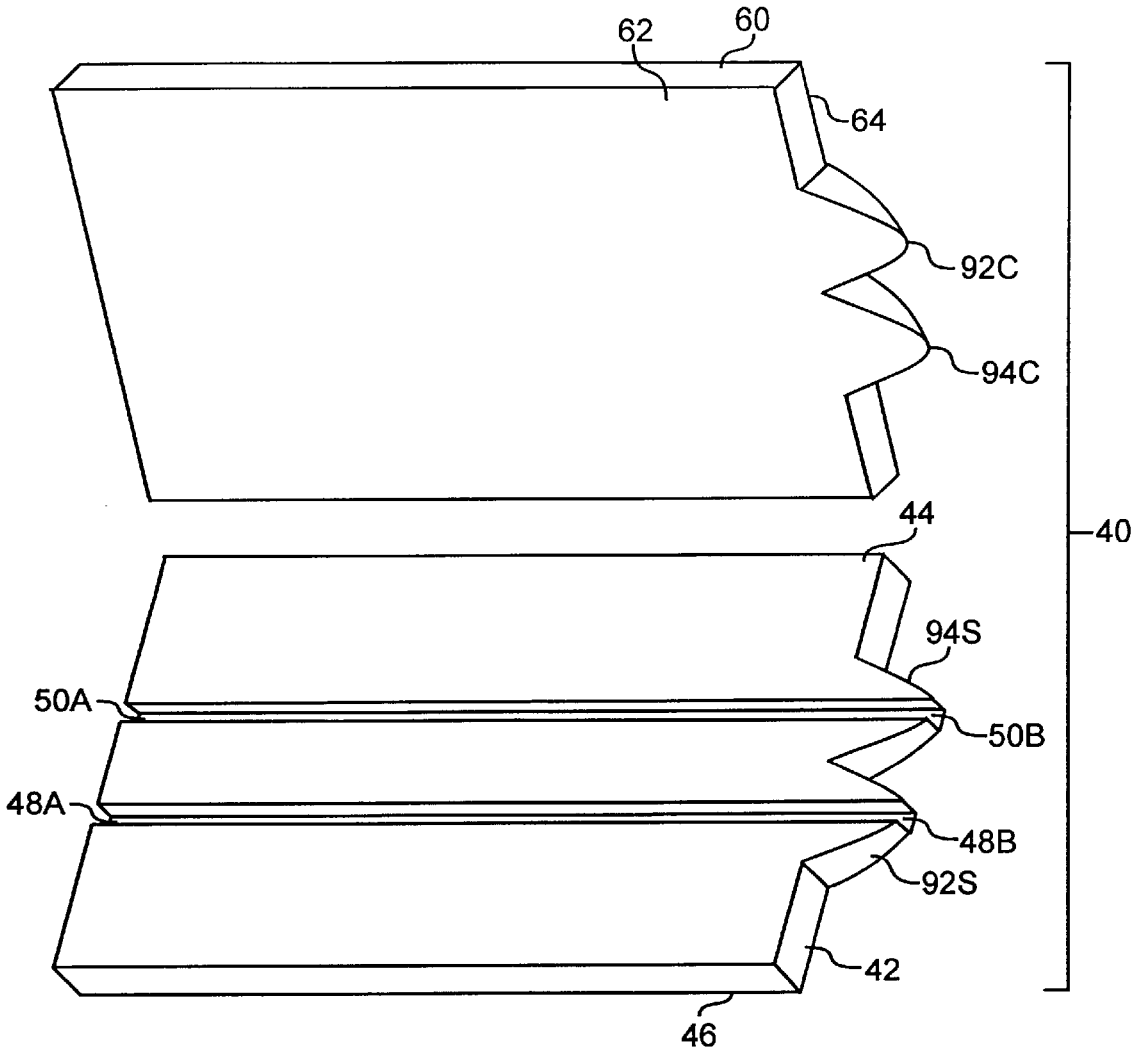
FIGS. 2A and 2B, collectively referred to as FIG. 2, illustrate a version of the fluid-transporting assembly in combination with an integrated mass spectrometer interface having a plurality of electrospray tips.

It is clear from the above description that the mass spectrometer interface may represent a separate component from the fluid-transporting assembly. In such a case, the mass spectrometer interface may be detachably or permanently affixed to the fluid-transporting assembly. Alternatively, the mass spectrometer interface may be an integral component of the fluid-transporting assembly. For example, FIG. 2 illustrates a version of the fluid-transporting assembly in combination with an integrated mass spectrometer interface having a plurality of electrospray tips. As depicted in FIG. 2A, the fluid-transporting assembly 40 may be formed from a substrate 42 and a cover plate 60. The fluid-transporting assembly illustrated in FIG. 2A is similar to that illustrated in FIG. 1A with two notable exceptions. First, optional fluid processing features are absent from the substrate surface 44. In addition, while both the substrate and the cover plate are generally rectangular in shape, the rectangular shape of the cover plate is modified by protrusions 92C and 94C, and the rectangular shape of the substrate is modified by protrusions 92S and 94S.

Figure 2B:
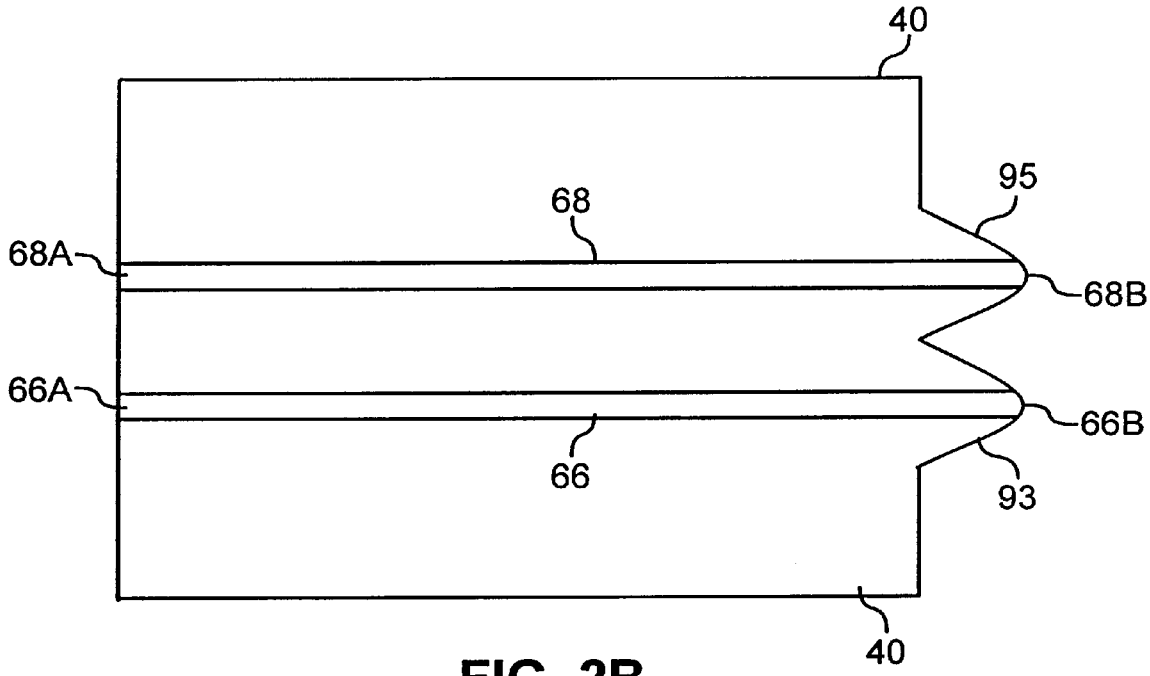

Located on surface 44 of substrate 42 are first and second parallel and identically sized microchannels, indicated at 48 and 50. Upstream termini 48A and 50A are located at the edge of the substrate that opposes protrusions 92S and 94S, respectively, and downstream termini 48B and 50B coincide with protrusions 92S and 94S, respectively. Cover plate contact surface 62 is arranged in fluid-tight relationship with respect to substrate contact surface 44, and as depicted in FIG. 2B, fluid-transporting conduits 66 and 68 are formed. As before, fluid-transporting conduits 66 and 68 are defined by microchannels 48 and 50, respectively, in combination with cover plate surface 62. The upstream termini 48A and 50A of the microchannels, in combination with the cover plate contact surface 62, form inlet ports 66A and 68A. Downstream termini 48B and 50B of the microchannels, in combination with cover plate contact surface 62, form outlet ports 66B and 68B, respectively. Nozzle 93 is formed from protrusions 92C and 92S, and nozzle 95 is formed from protrusions 94C and 94S. Thus, a first flow path is formed that travels, in succession, through inlet port 66A, conduit 66, outlet port 66B, and nozzle 93. Similarly, a second flow path is formed that travels, in succession, through inlet port 68A, conduit 68, outlet port 68B, and nozzle 95. Thus, nozzles 93 and 95 serve as a mass spectrometer interface that is an integral component of the fluid-transporting assembly.

Figure 3A:
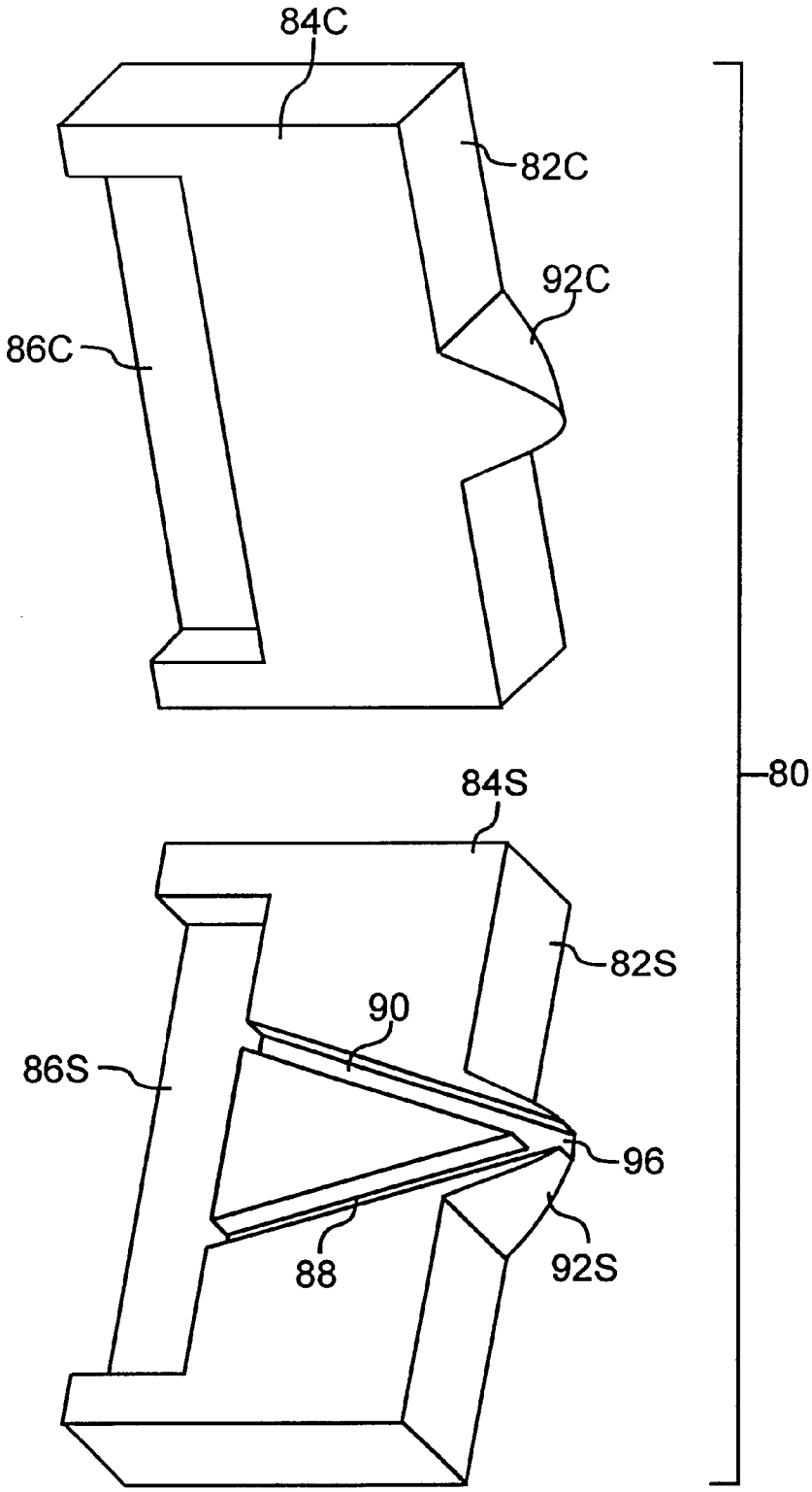
FIGS. 3A and 3B, collectively referred to as FIG. 3, illustrate a version of the mass spectrometer interface having a single electrospray tip.

FIG. 3 illustrates another version of a mass spectrometer interface 80. This interface is similar to that depicted in FIG. 1, except that it includes a single electrospray nozzle instead of two electrospray nozzles. As depicted in FIG. 3A, the interface is formed from two substantially identically shaped interface halves indicated at 82C and 82S, each having a surface indicated at 84C and 84S, respectively, that will ultimately be located within the assembled interface. Located on the contact surface 84S are channels 88 and 90 that extend from recess 86S to a common downstream terminus 96, located at protrusion 92S. In order to assemble the mass spectrometer interface, the halves 82C and 82S are assembled such that the surfaces 84C and 84S are in contact with each other and that protrusion 92C half 82C is superimposed over protrusion 92S of half 82S.

Figure 3B:
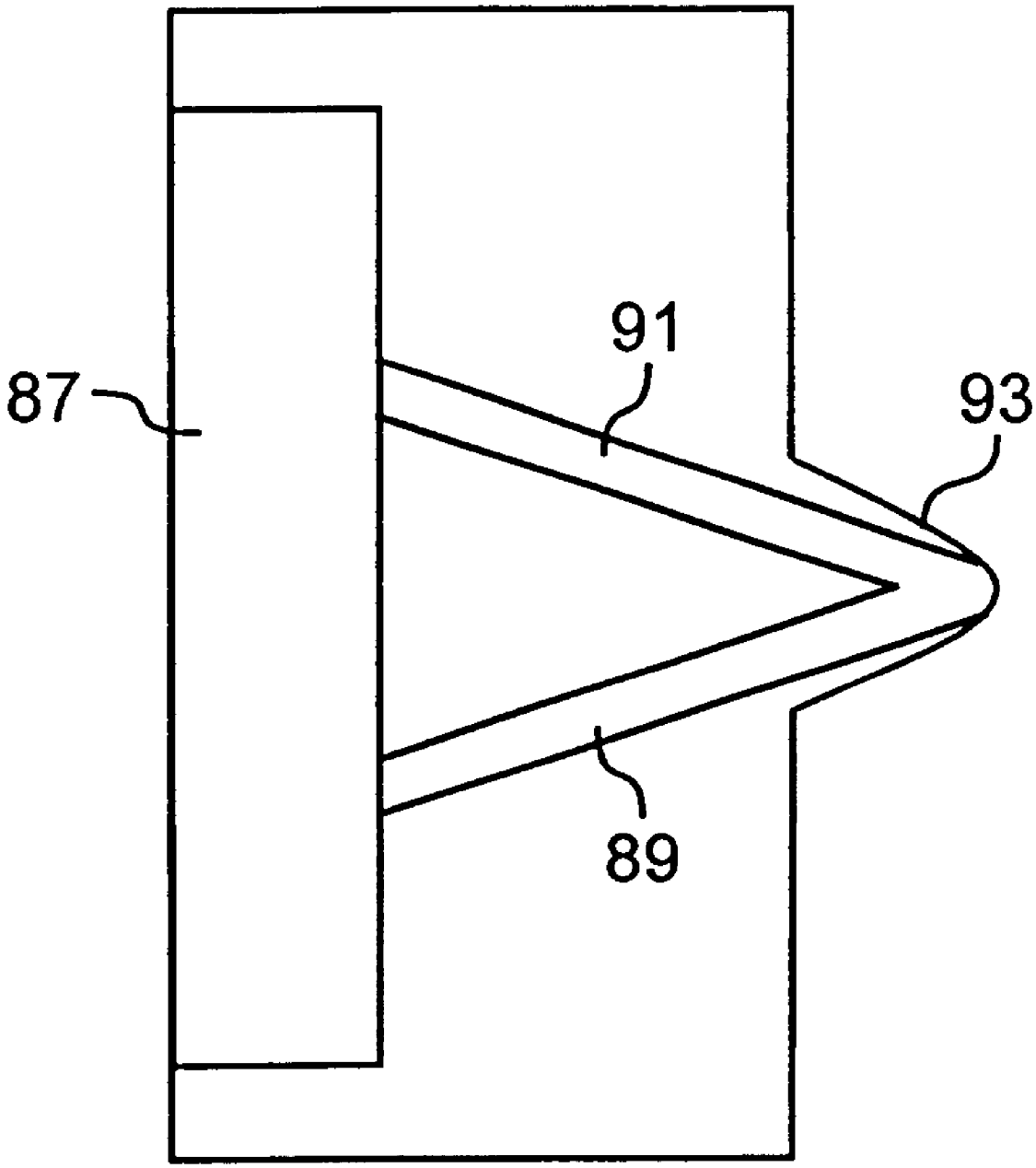

As depicted in FIG. 3B, the mass spectrometer interface is assembled such that recesses 86C and 86S form a receiving compartment 87 into which the downstream end of a fluid-transporting assembly may be inserted. Conduits 89 and 91 are formed by the combination of channels 88 and 90, respectively. Nozzle 93 is formed from protrusions 92C and 92S. Thus, conduits 89 and 91 each extend from receiving compartment 87 through a single nozzle 93.

Thus, the inventive device may be employed to transport one or more sample fluids to a mass spectrometer. The above device is assembled such that each inlet port of the fluid transporting assembly is placed in fluid communication with a different well of a well plate. The mass spectrometer interface is placed in position to introduce a sample fluid from the well plate into an inlet port of a mass spectrometer. Then, a motive force is applied to transport a sample fluid from a selected well of the well plate through the opening of the selected well, such that the conduit is in communication with the selected well, the mass spectrometer interface, and the inlet port of the mass spectrometer. Optionally, the motive force may be applied to allow one or more additional fluids from a different well to be transported into the inlet port of the mass spectrometer. Preferably, a sample from each well is transported into the mass spectrometer inlet. Optionally, at least one sample is processed before delivery into the mass spectrometer.

The invention may further include a motive means to transport sample fluid from each well upwardly through the fluid-transporting conduit in fluid communication therewith. Any of a number of means for inducing movement of a fluid can be adapted to transport a fluid from a well through the fluid-transporting assembly, and the mass spectrometer interface may be employed. For example, when the fluid-transporting conduits are of appropriate size and surface properties, one or more fluids may be transported through the conduits as a result of capillary or "wicking" action. In addition, the motive means may include applying a voltage differential to induce electrokinetic flow. See e.g., U.S. Pat. No. 6,033,628 to Kaltenbach et al. This may involve the use of electrodes in conjunction with the fluid-transporting assembly. Use of such electrodes to generate electrokinetic fluid movement is well known in the art of microfluidics and is described, for example in U.S. Pat. No. 5,779,868 to Parce et al. Furthermore, the motive means may involve pressurizing at least one of the wells of the well plate. For example, once the well plate interface forms a fluid-tight seal, the interface may serve as a septum through which a pressurizing needle may be inserted. Other motive means known in the art may be employed as well.

The mass spectrometer interface may be provided in a number of forms. See, e.g., U.S. patent application Ser. No. 09/324,344. As discussed above, the mass spectrometer interface may comprise one or more electrospray nozzles, though it is typically the case that the interface includes the same number of electrospray nozzles as the number of fluid-transporting conduits within the fluid-transporting assembly. Various nozzles for mass spectrometry are described in U.S patent application Ser. No. 09/711,804, which describes a similar microfluidic device having a protruding electrospray emitter. In addition, the mass spectrometer interface may include a mass spectrometer transfer line. Such transfer lines may include, for example, polymeric tubing, coated glass capillaries, and other conduits suitable for delivering one or more fluids to a mass spectrometer.

In order to ionize sample fluids for delivery into a mass spectrometer, a complete electrical circuit may be employed to ensure that a potential difference is generated between the mass spectrometer inlet opening and the mass spectrometer interface. Accordingly, the mass spectrometer interface may be formed entirely or partially with an electrically conductive material. For example, the interface may be coated with a conductive material to assist in the spraying process. While the conductive material may be polymeric or ceramic, such materials usually exhibit a lower conductivity than that of metals. Thus, metallization is preferred. The coating may contain one or more metallic elements. If the coating is to come into contact with the fluid that is transported through the inventive device, the coating should be inert with respect to the sample and may comprise, for example, gold, platinum, chromium, nickel, and/or other elements that tend to be chemically unreactive. The coating may be applied through any of a number of methods known to one of ordinary skill in the art and include, but are not limited to, electroplating, electron-beam sputtering, magnetronic sputtering, evaporation, electrodeless deposition, and solvent coating.

The coating is connected to a potential generating source or ground. When the interface is at ground, the mass spectrometer inlet opening is preferably at an ionization potential. However, the mass spectrometer inlet opening may or may not be at ground when the interface is not at ground. To enhance electrical contact with the fluid in the circuit and thereby create a more stable means of ionization, a conductive layer may be deposited on the interior surface of the mass spectrometer interface, the interior surfaces of the fluid-transport assembly conduits, or possibly on the interior surfaces of the wells or well plates. In addition or in the alternative, a conductive layer may be provided on an exterior surface of the mass spectrometer interface. In essence, the mass spectrometer interface is subjected to an electric field located between the interface and the mass spectrometer inlet opening. The electric field at the interface overcomes the liquid surface tension of the bulk fluid at the tip, such that fine charged droplets separate from the bulk fluid and subsequently move in accordance with their electric charge and the surrounding electric field.

Optionally, a nebulizing means may be provided to ensure that the droplet size is sufficiently small for introduction into the inlet opening of the mass spectrometer. Many types of nebulizers may be used, including, but not limited to, direct-injection, ultrasonic, high-efficiency, thermospray, and electrothermal vaporizing nebulizers. For example, the nebulizing means may comprise an integrated pneumatic nebulizer. Pneumatic nebulizers have two basic configurations. In the concentric type, the sample solution passes through a conduit surrounded by a high-velocity gas stream that flows parallel to the conduit axis. The crossflow type has the sample conduit set at about a right angle to the direction of a high-velocity gas stream. The V-groove and Babington-type nebulizers are generally considered to be of the crossflow type. In both configurations, a pressure differential created across the sample conduit draws the sample solution through the conduit. While both the crossflow and the concentric types of pneumatic nebulizers are commonly used, in general, the crossflow type is less susceptible to clogging caused by salt buildup than the concentric type. The concentric type of nebulizer, however, does not require adjustment of the gas and liquid conduits, while the performance of the crossflow type depends heavily on the relative position of the gas and liquid conduits.

Moreover, the device may be adapted to introduce sample fluids of virtually any type into a mass spectrometer. The fluid may be aqueous and/or nonaqueous. Examples of fluids include, but are not limited to, aqueous fluids including water per se and water-solvated ionic and nonionic solutions, organic solvents, and biomolecular liquids.

Variations of the invention, not explicitly disclosed herein, will be apparent to those of ordinary skill in the art. It is to be understood that, while the invention has been described in conjunction with the preferred specific embodiments thereof, the foregoing description is intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

We claim:

1. A device for transporting a sample fluid into a mass spectrometer, the device comprising:

a well plate comprising a plurality of wells, wherein each well is defined by an interior surface extending downwardly from an opening at an upper surface of the well plate;

a fluid-transporting assembly comprising a plurality of fluid-transporting conduits, each extending from an inlet port to an outlet port, wherein the assembly exhibits sufficient flexibility to allow movable positioning of the outlet ports with respect to the inlet ports;

a mass spectrometer interface in fluid communication with the outlet ports of the fluid-transporting assembly, wherein each inlet port of the fluid transporting assembly is positioned in fluid communication with a different well of the well plate, and each well represents the origin of a flow path that travels, in succession, through a well plate opening, an inlet port, a fluid-transporting conduit, an outlet port, and the mass spectrometer interface.

2. The device of claim 1, wherein the well openings are coplanar.

3. The device of claim 1, wherein the well plate comprises at least 96 wells.

4. The device of claim 3, wherein the well plate comprises at least 384 wells.

5. The device of claim 4, wherein the well plate comprises at least 1536 wells.

6. The device of claim 1, wherein the fluid-transporting assembly comprises a substrate and a cover plate arranged in fluid-tight relationship over the substrate surface, wherein the fluid-transporting conduits are each defined by a channel formed in the substrate surface in combination with the cover plate.

7. The device of claim 6, wherein the substrate, the cover plate, or both are comprised of a polymeric material.

8. The device of claim 7, wherein the polymeric material is a biofouling-resistant material.

9. The device of claim 8, wherein the biofouling-resistant material is polyimide.

10. The device of claim 6, wherein the fluid-transporting conduits are parallel to each other.

11. The device of claim 6, wherein the fluid-transporting conduits are substantially identically sized.

12. The device of claim 6, further comprising a plurality of processing chambers, each in fluid communication with a conduit of the fluid-transporting assembly, wherein the processing chambers are downstream from the well plate and upstream from the mass spectrometer interface.

13. The device of claim 12, wherein the processing chambers are located between the substrate and cover plate and communicate the conduits downstream from the inlet ports and upstream from the outlet ports.

14. The device of claim 6, wherein the mass spectrometer interface is formed from a portion of the cover plate.

15. The device of claim 14, wherein the mass spectrometer interface is formed from a portion of the substrate.

16. The device of claim 6, wherein the mass spectrometer interface is formed from a portion of the substrate.

17. The device of claim 1, further comprising a plurality of processing chambers, each in fluid communication with a conduit of the fluid-transporting assembly, wherein the processing chambers are downstream from the well plate and upstream from the mass spectrometer interface.

18. The device of claim 1, wherein the mass spectrometer interface comprises an electrospray nozzle.

19. The device of claim 18, wherein the mass spectrometer interface comprises a plurality of electrospray nozzles.

20. The device of claim 19, wherein the mass spectrometer interface comprises the same number of electrospray nozzles as the number of fluid-transporting conduits of the fluid-transporting assembly.

21. The device of claim 18, further comprising a nebulizing means for nebulizing fluid emerging from the electrospray nozzle.

22. The device of claim 1, wherein the mass spectrometer interface comprises electrically conductive material.

23. The device of claim 22, wherein electrically conductive material is a metallization layer on a surface of the mass spectrometer interface.

24. The device of claim 23, wherein the metallization layer is on an interior surface of the mass spectrometer interface.

25. The device of claim 23, wherein the metallization layer is on an exterior surface of the mass spectrometer interface.

26. The device of claim 22, wherein the electrically conductive material is electrically connected to ground.

27. The device of claim 22, further comprising a potential generation means electrically connected to the conductive material.

28. The device of claim 1, wherein the mass spectrometer interface is attached to the fluid-transporting assembly.

29. The device of claim 1, further including a motive means to transport sample fluid from each well upwardly through the fluid-transporting conduit in fluid communication therewith.

30. The device of claim 29, wherein the motive means comprises a means for applying a voltage differential to induce electrokinetic flow.

31. The device of claim 29, wherein the motive means comprises a means for pressurizing at least one of the wells of the well plate.

32. A mass spectrometric analytical device comprising:

a well plate comprising a plurality of wells, wherein each well is defined by an interior surface extending downwardly from an opening at an upper surface of the well plate;

a fluid-transporting assembly comprising a substrate having a plurality of microchannels formed in a surface thereof, and a cover plate arranged in fluid-tight relationship over the substrate surface, the cover plate and the microchannels together defining a plurality of fluid-transporting conduits, each extending from an inlet port to an outlet port;

a mass spectrometer interface in fluid communication with the outlet ports of the fluid-transporting assembly, wherein each inlet port of the fluid transporting assembly is positioned in fluid communication with a different well of the well plate, and each well represents the origin of a flow path that travels, in succession, through a well plate opening, an inlet port, a fluid-transporting conduit, an outlet port, and the mass spectrometer interface; and a mass spectrometer inlet opening in fluid-receiving relationship to the mass spectrometer interface;

wherein the fluid-transporting assembly is arranged such that direction of the flow path from the wells to the fluid-transporting assembly differs from the direction of the flow path from the mass spectrometer interface to the mass spectrometer inlet opening.

33. A method for transporting a sample fluid to a mass spectrometer, comprising:

(a) providing a mass spectrometer interface and a fluid-transporting assembly comprising a plurality of fluid-transporting conduits, each extending from an inlet port to an outlet port and exhibiting sufficient flexibility to allow movable positioning of the outlet port with respect to the inlet port, wherein at least one outlet port is in fluid communication with the mass spectrometer interface;

(b) placing each inlet port of the fluid transporting assembly in fluid communication with a different well of a well plate, wherein the well plate comprises a plurality of wells each containing a sample fluid and further wherein each well is defined by an interior surface extending downwardly from an opening at an upper surface of the well plate;

(c) positioning the mass spectrometer interface so that sample fluid from the well plate is introduced into an inlet port of a mass spectrometer;

(d) applying a motive force to transport sample fluid from a selected well of the well plate through the opening of the selected well, such that the conduit is in fluid communication with the selected well, the mass spectrometer interface, and the inlet port of the mass spectrometer, wherein the direction in which the sample fluid is transported through the opening of the selected well is different from the direction in which the sample fluid is transported through the inlet port of the mass spectrometer.

34. The method of claim 33, wherein step (d) is repeated for a different well of the well plate.

35. The method of claim 33, wherein step (d) is repeated for all wells of the well plate.

36. The method of claim 33, further comprising during step (d), (d') processing the sample fluid within the fluid-transport assembly.

* * * * *